US008005385B2

(12) United States Patent
Gross et al.

(10) Patent No.: US 8,005,385 B2
(45) Date of Patent: Aug. 23, 2011

(54) ELECTROPHOTOGRAPHIC SYSTEM TO ENABLE DIRECT SENSING OF TONER QUANTITY

(75) Inventors: Eric M. Gross, Rochester, NY (US); James P. Kitchen, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 218 days.

(21) Appl. No.: 11/810,255

(22) Filed: Jun. 5, 2007

(65) Prior Publication Data

US 2008/0304841 A1 Dec. 11, 2008

(51) Int. Cl.
*G03G 15/10* (2006.01)

(52) U.S. Cl. ..... 399/60

(58) Field of Classification Search ..... 399/49, 399/72, 74, 58, 60

See application file for complete search history.

(56) References Cited

U.S. PATENT DOCUMENTS 5,162,874 A * 11/1992 Butler ..... 356/446
5,274,424 A * 12/1993 Hattori et al. ..... 399/49
5,519,497 A 5/1996 Hubble, III et al.
5,559,579 A * 9/1996 Gwaltney et al. ..... 399/59
5,574,527 A 11/1996 Folkins
5,604,567 A 2/1997 Dundas et al.
5,606,721 A 2/1997 Thayer et al.
5,612,902 A 3/1997 Stokes
5,649,073 A 7/1997 Knox et al.
5,666,194 A 9/1997 Denton
5,749,020 A 5/1998 Mestha et al.
5,777,656 A 7/1998 Henderson
5,887,221 A 3/1999 Grace
5,903,797 A 5/1999 Daniels et al.
5,950,040 A 9/1999 Mestha et al.
5,963,244 A 10/1999 Mestha et al.
6,035,152 A 3/2000 Craig et al.
6,181,888 B1 1/2001 Scheuer et al.
6,201,936 B1 * 3/2001 Gross et al. ..... 399/49
6,272,295 B1 8/2001 Lindblad et al.
6,462,821 B1 * 10/2002 Borton et al. ..... 356/446
6,639,699 B2 10/2003 Matsuyama
2004/0042807 A1 * 3/2004 Nakayama ..... 399/49
2006/0024077 A1 * 2/2006 Scheuer et al. ..... 399/74
2006/0071963 A1 * 4/2006 Sampath et al. ..... 347/19

* cited by examiner

*Primary Examiner* — David Gray
*Assistant Examiner* — Gregory H Curran
(74) *Attorney, Agent, or Firm* — Fay Sharpe LLP

(57) ABSTRACT

A system is provided that determines the amount of toner on a photo receptor in a xerographic operation. A photo receptor is charged in one or more locations to create an image. A developer places a patch of a predetermined amount of toner onto the one or more charge locations of the photo receptor. A light emitting diode projects light onto the photo receptor, wherein the intensity of the light varies based on the voltage provided to the LED. An optical reflective sensor measures the reflectance of the toner placed on the photo receptor, the amount of reflectance of the toner is related in a known way to the intensity of the LED. A direct relationship between LED intensity and the reflectance of the toner allow for accurate extrapolation at LED intensities greater than the point of saturation.

10 Claims, 3 Drawing Sheets

ELECTROPHOTOGRAPHIC SYSTEM TO ENABLE DIRECT SENSING OF TONER QUANTITY

BACKGROUND

The following relates to toner density control in xerographic applications. It finds particular application in utilizing optical reflection to measure black toner density levels of solid patches placed on a clean belt. Application to other colors and to halftone levels, however, is not excluded.

In copying or printing systems such as a xerographic copier, laser printer or inkjet printer, a common technique for monitoring the quality of prints is to artificially create a test patch of a predetermined desired density. The actual density of the printing material, toner or ink for example, in the test patch can then be optically measured to determine the effectiveness of the printing process in placing this printing material on the print sheet.

In the case of xerographic devices such as a laser printer, the surface that is typically of most interest in determining the density of printing material thereon is the charge retentive surface or photoreceptor on which the electrostatic latent image is formed and subsequently developed by causing toner particles to adhere to areas thereof that are charged in a particular way. In such a case an optical device, often referred to as a densitometer, for determining the density of toner on the test patch is disposed along the path of the photoreceptor directly downstream of the development unit. There is typically a process within the operating system of the printer to periodically create test patches of the desired density at predetermined locations on the photoreceptor by deliberately causing the exposure system thereof to change or discharge as necessary the surface at the location to a predetermined extent.

The test patch is then moved past the developer unit and the toner particles within the developer unit are caused to adhere electrostatically. The denser the toner on the test patch, the darker the test patch will appear in optical testing. The developed test patch is moved past a densitometer disposed along the path of the photoreceptor and the light absorption of the test patch is tested. The density of toner on the patch varies in relationship to the percentage of light absorbed by the test patch.

Xerographic test patches that are used to measure the deposition of toner on paper to measure and control the tone reproduction curve (TRC) are traditionally printed on interdocument zones of photoreceptor belts or drums. Generally, each patch that is printed is a uniform solid halftone or background area. This practice enables the sensor to read values on the TRC.

Many xerographic printing system process controls move physical actuators such as developer bias, charge level and raster output scanner (ROS) intensity to maintain the TRC as measured by an in-line optical sensor. Optical reflective sensing of black solid patches at desirable densities can, in particular, suffer from a limited sensing range. Black toner has minimal diffuse reflection and specular reflection typically saturates near or below the developed mass per unit area (DMA) target level.

To overcome this difficulty, development curve measurement and projection schemes have been implemented (e.g., iGen3 patch generator approach) or high digital area coverage halftones that are somewhat correlated with solids have been used. The latter approach suffers to the extent that the correlation is poor, and the previous approach relies on extrapolation and has hardware overhead costs, software complexity, and bandwidth limitations.

In order to remedy this problem, alternative systems and methods need to be employed to more accurately determine patch density. Such identification can provide more consistent and accurate control over the quantity of toner, i.e. color, utilized for various applications.

BRIEF DESCRIPTION

In one aspect, a system determines the amount of toner on a photo receptor in a xerographic operation. A photo receptor is charged in one or more locations to create an image. A developer places a patch of predetermined amount of toner onto the one or more charge locations of the photo receptor. A light emitting diode (LED) projects light onto the photo receptor, wherein the intensity of the light varies based on the voltage provided to the LED. An optical toner sensor with a saturation value measures the reflectance of the toner placed on the photo receptor, the amount of reflectance of the toner very well approximated as linearly related to the intensity of the LED.

In another aspect, a method is employed to measure the mass of toner on a photo receptor during a xerographic process. A patch of toner is placed on a photo receptor and a light is emitted onto the patch via an intensity of a light emitting diode (LED). The amount of light reflected off the patch is read as a specular voltage via an optical sensor.

In yet another aspect, a method is employed to measure the mass of toner in a xerographic process. A patch of toner is placed on a photo receptor belt in between two images. Light is emitted onto the patch via a predetermined intensity of a light emitting diode (LED). A relationship is determined between a specular reflectance of the patch and the intensity of the LED. The specular reflectance value of the patch is calculated based upon the intensity of the LED.

DETAILED DESCRIPTION

It will become evident from the following discussion that embodiments of the present application set forth herein, are suited for use in a wide variety of printing and copying systems, and are not necessarily limited in application to the particular systems illustrated.

Figure 1:
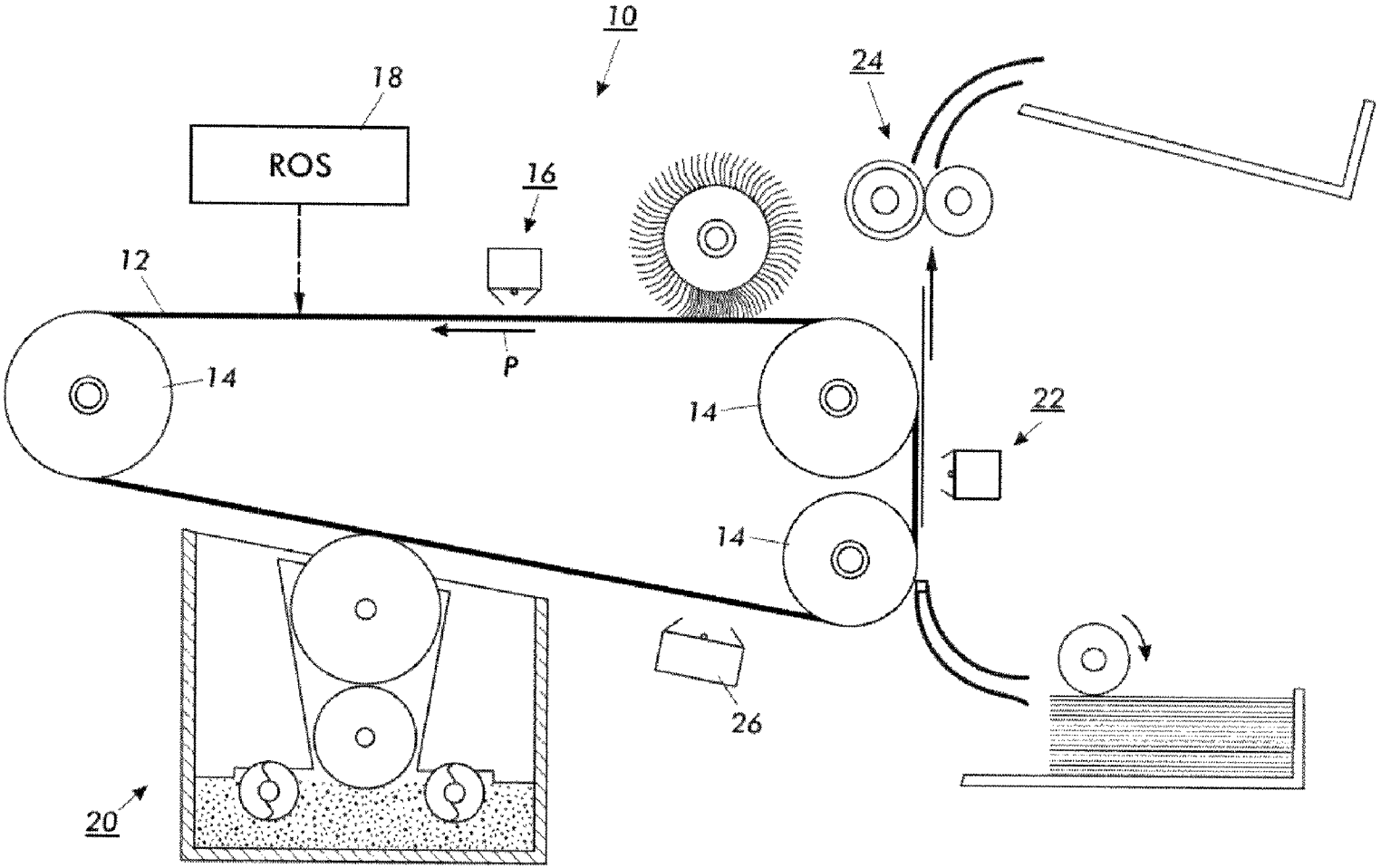
FIG. 1 illustrates a xerographic printing system, in accordance with an aspect of the present embodiment.

FIG. 1 is a schematic representation of a well-known system suitable for incorporating elements of the present embodiment. Included within printing electrophotographic system 10 is a photoreceptor 12 which may be in the form of a belt or drum and which comprises a charge retention surface. In this embodiment, photoreceptor 12 is entrained on a set of rollers 14 and caused to move in a counter-clockwise process direction by means such as a motor (not shown).

The first step in an electrophotographic process is the charging of the relevant photoreceptor surface. This initial charging is performed by charge source 16. The charged portions of the photoreceptor 12 are then selectively discharged in a configuration corresponding to the desired image to be printed by a raster output scanner (ROS) 18. ROS 18 generally comprises a laser source (not shown) and a rotatable mirror (also not shown) acting together in a manner known in the art to discharge certain areas of the charged photoreceptor 12. Although a laser source is shown in the exemplary embodiment, other systems that can be used for this purpose include, for example, an LED bar or a light lens system. The laser source is modulated in accordance with digital image data fed into it and the rotating mirror causes the modulated beam from the laser source to move in a fast scan direction perpendicular to the process direction of the photoreceptor 12. The laser source outputs a laser beam of sufficient power to charge or discharge the exposed surface on photoreceptor 12 in accordance with a specific machine design.

After selected areas of the photoreceptor 12 are discharged by the laser source, remaining charged areas are developed by developer unit 20 causing a supply of dry toner to contact the surface of photoreceptor 12. The developed image is then advanced by the motion of photoreceptor 12 to a transfer station including a transfer device 22, causing the toner adhering to the photoreceptor 12 to be electrically transferred to a substrate, which is typically a sheet of paper, to form the image thereon. The sheet of paper with the toner image thereon is then passed through a fuser 24, causing the toner to melt or fuse into the sheet of paper to create a permanent image. It is to be appreciated that toner can refer to substantially any color such as cyan, yellow, magenta and/or black.

In one approach, toner is placed directly on the surface of the photoreceptor 12 belt in the form of a patch. This patch can be comprised of a solid area of toner or a halftone. Toner placement can occur periodically such as between a particular number of sheets of paper, based on time, etc. An optical sensor 26 can measure the reflectance of the toner placed on the belt. This reflectance can correlate with one or more characteristics of the toner such as density, color, quality, etc. In one approach, the reflectance of the toner is related to developed mass per unit area.

Figure 2:
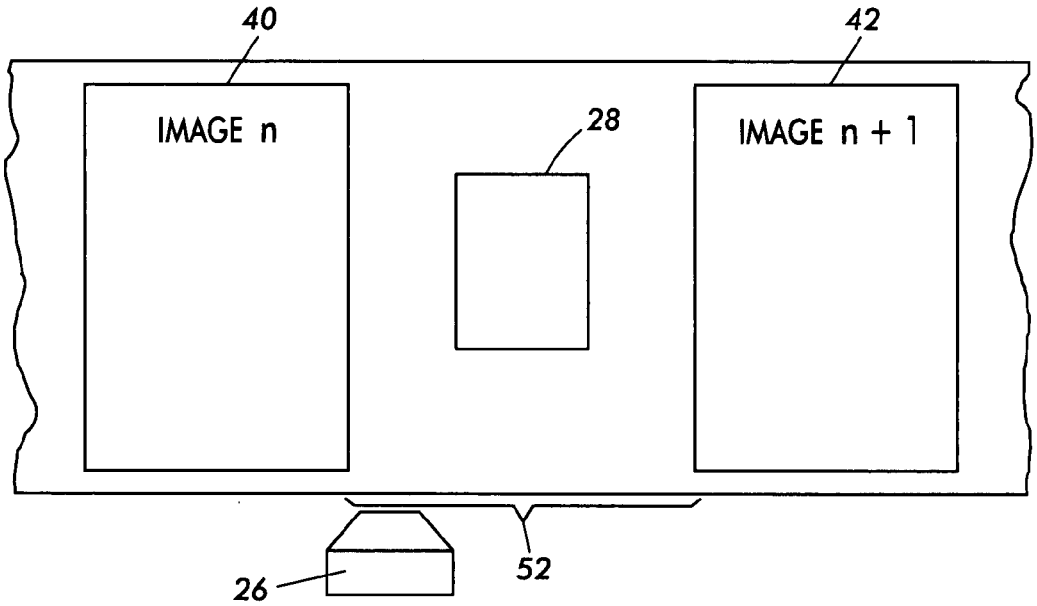
FIG. 2 illustrates a test patch and a photo receptor, in accordance with an aspect of the subject embodiment.

FIG. 2 illustrates a process method that uses the optical sensor 26 to monitor the reflectance of a patch 28 placed on the photoreceptor 12 in between a first document 40 and a second document 42. The sensor 26 monitors the reflectance of the patch 28 (e.g., a black solid patch in this specific example) placed in the inter-document zone 52 of the photoreceptor 12. It is to be appreciated that the arrangement of the patch 28 and the sensor 26 is provided as an aid to understanding concepts of the present embodiment. Other arrangements of patches (e.g., more than one patch), with one or more sensors, are envisioned and fall within the scope of the present embodiment.

In operation of the sensor 26, collimated light rays are projected onto the photoreceptor 12 which includes the patch 28. The light rays reflected from the patch 28 are collected and directed onto a photodiode array (not shown). The photodiode array generates electrical signals proportional to the total flux and a diffuse component of the total flux of the reflected light rays. The ETAC sensor 26 thus measures the amount of filming on the photoreceptor after the cleaning station using reflected infrared light. In one embodiment, the electrical signal output of the ETAC sensor 26 is in terms of voltage.

In one approach, the linear clean belt response to sensor LED intensity is employed to project to a clean belt read beyond a saturation point. The saturation point can be described as the maximum level of light reflectance that can be read by the ETAC sensor 26. Once the saturation point is reached, an increase in the amount of light will not result in a change of the signal output of the sensor 26. For this reason, under conventional systems, the sensor could only provide useful information when the light reflectance was at or below the saturation point.

In contrast, and as described herein, the output of the sensor 26 can be determined based on a known relationship between the light intensity and corresponding electrical output of the sensor 26. The relationship between light intensity and electrical output of the sensor 26 (specular read voltage) may be described in one of a first, second or third order equation. The particular order of the equation relates to the order of the derivative of a variable. In one example, the relationship between light intensity and sensor output is linear. In another example, such a relationship is described by a polynomial. Utilizing such a known relationship, a second value (e.g. light intensity) can be calculated based on a known first value (e.g. specular read voltage). It is to be appreciated that substantially any relationship can be identified.

The projected clean belt read can be utilized to determine the relative reflectance for the solid area of the patch 28. It is known that the relative reflectance (the ratio of specular response to the specular clean belt response) is correlated with DMA. In computing the relative reflectance, sensor to sensor and photoreceptor to photoreceptor differences are compensated. Thus, the constraint of maintaining the clean belt read within the sensing range of the device is broken to permit wider latitude in setting the LED intensity to optimize the sensing range as a function of the patch 28 density.

Figure 3:
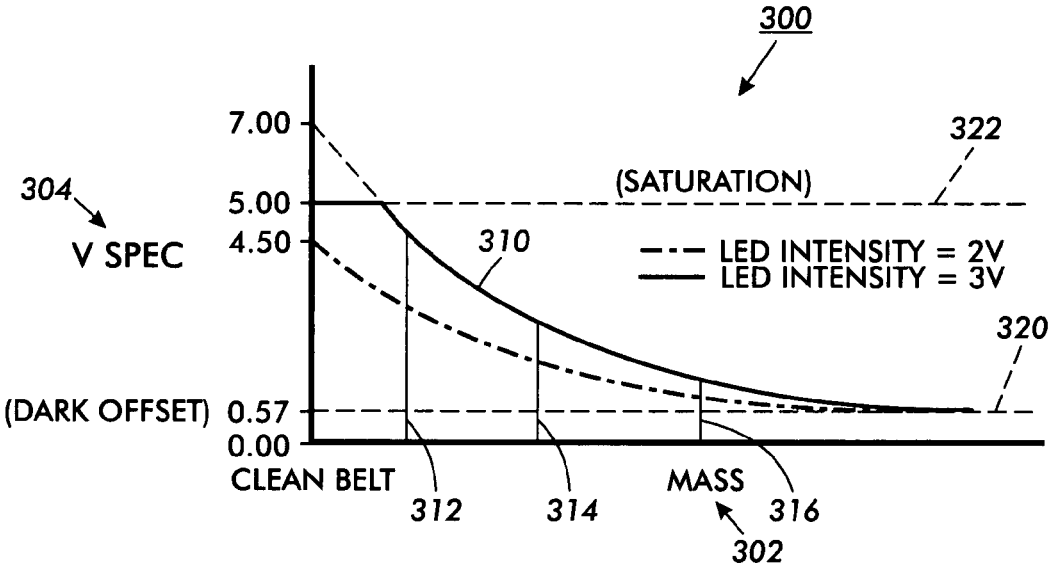
FIG. 3 illustrates a relationship between a specular voltage value and a mass of toner, in accordance with an aspect of the subject embodiment.

FIG. 3 illustrates a relationship 300 between developed mass 302 on the photoreceptor 12 and the specular voltage reading (Vspec) 304 from the Extended Toner Area Coverage (ETAC) sensor 26. The bare photoreceptor 12 (e.g., clean belt) gives a maximum reflectance of specular light, which is known as the clean belt read. As more toner is developed, it either absorbs the incident light or scatters it as diffuse light. Both of these decrease the amount of specular light that is reflected back to the sensor 26. For solid patches at sufficiently high masses (typically at or below the target DMA), the specular ETAC reading is a non-zero value known as the dark offset, the output of the sensor when no light is detected. To first order, this is the minimum reading for the sensor 26; the same reading occurs when the LED light is turned off.

For higher LED intensities, the specular response to mass curve shifts up, as illustrated by solid curve 310. This higher intensity gives several benefits that allow for solid patches to be measured from the specular sensor reading. First, for a constant mass 312, 314, or 316, the signal is further away from the dark offset value, leading to greater sensing range at high masses. Second, for any constant specular sensor reading 320 or 322, higher intensities correspond to higher masses on the photoreceptor 12. Therefore, controlling the process to the same specular voltage target with a higher LED intensity will yield a greater mass reading.

Figure 4:
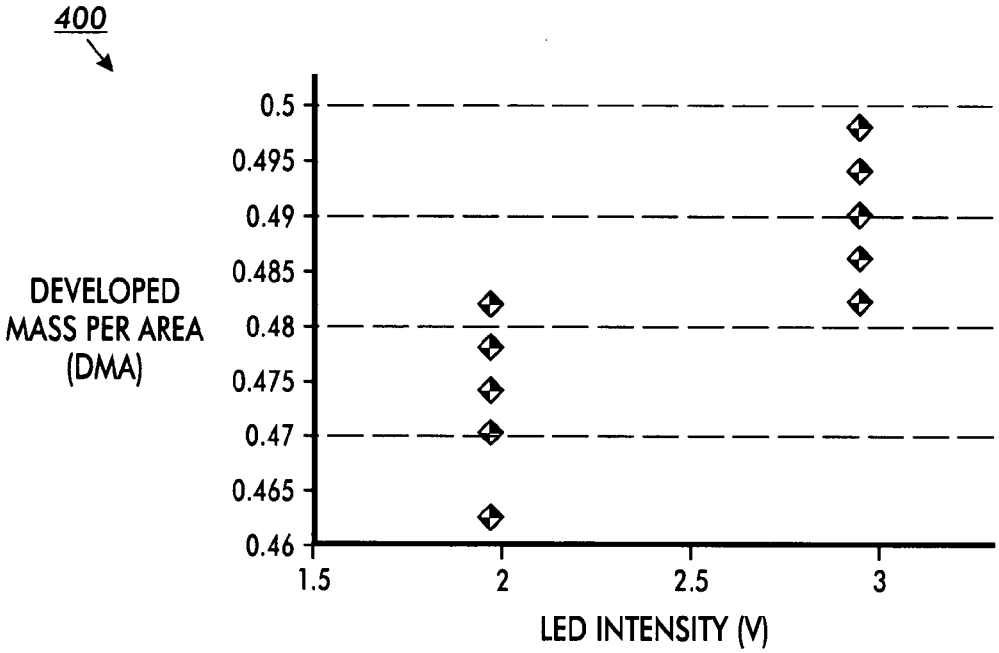
FIG. 4 illustrates a relationship between an LED intensity and a developed mass per area value, in accordance with an aspect of the subject embodiment.

FIG. 4 is a graph 400 that illustrates an increase in DMA due to a higher LED intensity. To demonstrate that higher LED intensities do, in fact, increase the mass readings, several prints were run on an iGen machine at the machine LED intensity setting of around 2 Volts. As known in the art, an iGen machine is a high speed digital color printing press.

Next, the LED intensity was increased to roughly 3 Volts. The transmission density was measured for the prints and then converted to DMA.

One challenge to increasing LED intensity to desirable levels is that the specular clean belt reads saturate at a value of 5 Volts. Any clean belt readings above this threshold will be indistinguishable. It is important to note that increasing the LED intensity will still yield higher masses reading. However, without an accurate clean belt read to compensate for sensor to sensor and photoreceptor to photoreceptor differences, the mass density control will be inaccurate. The traditional way to deal with this is to target a clean belt reading that is below the saturation threshold (e.g., between 4.3 and 4.6 volts). Unfortunately, this does not give adequate range for developing solids at the desired mass target.

Figure 5:
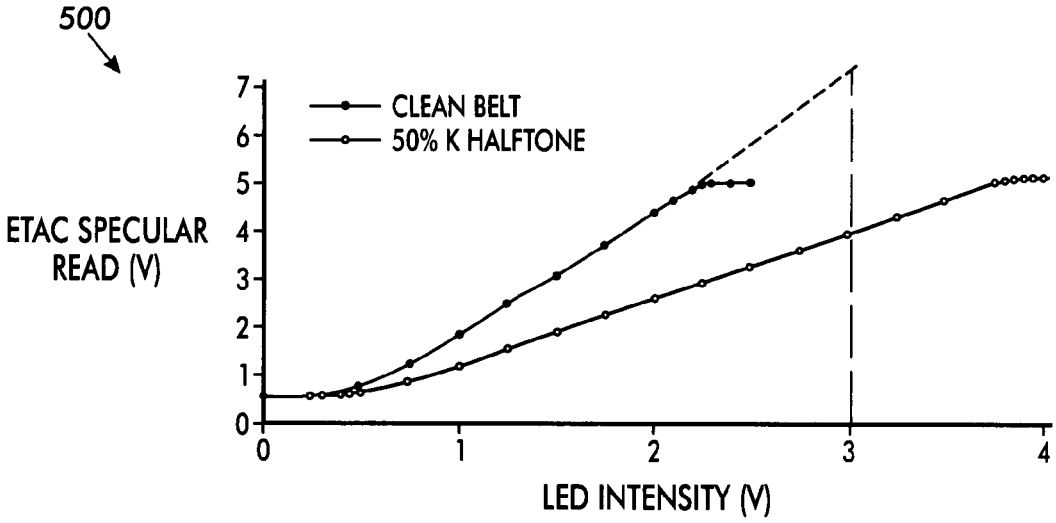
FIG. 5 illustrates a relationship between an LED intensity and a specular voltage value, in accordance with an aspect of the subject embodiment.

The solution to this issue is to construct a virtual clean belt read from clean belt readings at lower LED intensities. These clean belt readings have a reasonably assumed linear relationship 500 (between the dark offset and upper saturation limit) with LED intensity, as shown in FIG. 5. The relationship of LED intensity to light output is also shown to be linear for a fifty percent black halftone patch. Such a linear correlation can be extrapolated at LED intensities greater than the values normally applied. As shown, the linear relationship holds well beyond 3V of intensity in the fifty percent half tone curve. It is to be appreciated, however, that substantially any identifiable relationship can be employed. For example, a relationship between two metrics that is described by a particular function (e.g., sinusoid, polynomial, etc.) can be extrapolated to increase the measurement range to include higher DMA levels.

In this manner, the LED intensity can be increased to levels beyond a saturation point (e.g., 5V) to provide a virtual clean belt reading. As illustrated, as the LED intensity is increased from approximately 2.25V to 3V, a virtual clean belt reading that corresponds linearly can be identified. In one example, when the LED intensity is increased to 3V, a virtual clean belt reading of 7V is recognized. This reading is higher than the 5V maximum read utilizing conventional measurement techniques. In contrast, this measurement technique disclosed herein can eliminate the need for the additional hardware necessary in the iGen architecture to control black solids and can allow current sensors to measure black solids, which they previously were unable to do.

Because there is a linear relationship, the clean belt curve can be extrapolated beyond the point of saturation to find the LED intensities corresponding to higher clean belt specular voltage readings. Using these higher LED operating intensities would not be functional for light patches (the sensor would still saturate until a sufficient mass is rendered), but would extend the measurement capability of higher DMA levels. As an example of implementation, the iGen3 architecture currently allows for toggling the LED intensity between different levels depending on the patch being measured, allowing a lower LED intensity to be used to measure low and mid-patches, and a higher LED intensity to be used to measure solid patches.

In summary, the innovation described herein extends the range of useable LED intensities beyond what would normally saturate the specular sensor by using a virtual clean belt reading, thereby allowing solid patches to be effectively measured and controlled with the specular ETAC sensor. Without the virtual clean belt reading, the LED intensities do not provide enough range to adequately measure and control solid patches to requisite mass levels. In this manner, finisher costs associated with a xerographic process can be reduced. Further, a lower number of components that utilize conventional means can be realized.

It will be appreciated that variations of the above-disclosed and other features and functions, or alternatives thereof, may be desirably combined into many other different systems or applications. Various and variant embodiments presently unforeseen or unanticipated alternatives, modifications, variations or improvements therein may be subsequently made by those skilled in the art which are also intended to be encompassed by the following claims. In addition, the claims can encompass embodiments in hardware, software, or a combination thereof.

The invention claimed is:

1. A method for measuring the mass of toner on a photoreceptor during a xerographic process, comprising:

constructing at least one clean belt reading at intensity levels below a known saturation level;

determining a direct relationship between specular voltage and LED intensity;

extrapolating at least one virtual clean belt reading beyond said known saturation level of light intensity based on said direct relationship;

placing a patch of toner on a photoreceptor;

emitting a light onto the patch via a known intensity of a light emitting diode (LED);

reading the amount of light reflected off the patch as a specular voltage via an optical reflective sensor, wherein said LED is part of said sensor;

determining if the specular voltage exceeds said saturation level; and calculating the specular voltage value of said patch based upon the known direct relationship between the specular voltage and the LED intensity, wherein said known relationship is such that the value of one of said voltage and said intensity can be determined based on a known value of the other of said voltage and said intensity.

2. The method according to claim 1, wherein the patch of toner is placed between two substrates, the substrates are at least one of a velum, a paper and an acetate.

3. The method according to claim 1, wherein the calculation is performed only when the sensor is at or above the saturation value.

4. The method according to claim 1, wherein the intensity of the LED is varied by changing a voltage level provided to the LED.

5. The method according to claim 1, wherein the relationship between the specular voltage and the LED intensity is linear.

6. The method according to claim 1, wherein the mass of the toner patch is related to the value of the specular voltage value.

7. The method according to claim 1, wherein the specular read voltage is related to the toner color of the patch.

8. A method that measures the mass of toner in a xerographic process, comprising:

placing a patch of toner on a photoreceptor belt in between two sheets of paper;

emitting light onto the patch via a predetermined intensity of a light emitting diode (LED);

discharging locations of said photoreceptor in a configuration corresponding to a desired image using a raster output scanner;

calculating at least one clean belt reading by emitting light at intensity levels below a known saturation level;

determining a direct relationship between the specular reflectance value and LED intensity;

extrapolating at least one virtual clean belt reading beyond said known saturation point of light intensity based on said direct relationship, wherein the value of one of the specular reflectance value and LED intensity can be determined based on a known value of the other of said specular reflectance value and LED intensity;

calculating the specular reflectance value of the patch based upon the intensity of the LED.

9. The method according to claim 8, wherein the relationship between the specular reflectance of the patch and the intensity of the LED is linear.

10. The method according to claim 8, wherein the mass of the toner patch is related to the value of the specular reflectance value.

* * * * *